United States Patent [19]

Offterdinger

[11] 4,006,513

[45] Feb. 8, 1977

[54] RUNNER WHEEL SUPPORT

[76] Inventor: Hermann Friedrich Offterdinger, 602 Galway Drive, Burlington, Ontario, Canada

[22] Filed: June 25, 1975

[21] Appl. No.: 590,199

[52] U.S. Cl. ..... 16/99; 16/105; 49/420; 49/425

[51] Int. Cl.[2] ..... E05D 13/02

[58] Field of Search ..... 16/99, 105, 91, 97, 16/102, 103, 104; 49/420, 425

[56] References Cited

UNITED STATES PATENTS

| | | | |
|---|---|---|---|
| 3,526,995 | 9/1970 | Saunders | 16/91 X |
| 3,716,890 | 2/1973 | Benson | 16/99 X |
| 3,731,431 | 5/1973 | Banner | 16/99 X |

*Primary Examiner*—Werner H. Schroeder
*Assistant Examiner*—Conrad L. Berman
*Attorney, Agent, or Firm*—Hirons & Rogers

[57] ABSTRACT

A runner wheel support for sliding doors, windows and the like consists of a support body which is a press fit in the respective frame, and which carries the support wheel or roller on an arm carried by a disengageable pivot. The wheel support arm has a cam member cooperating with a height adjustment screw and spring fingers on the support body to hold the wheel support in a stored position while the support body is fitted into a frame member, and thereafter to free the wheel support from this stored position and to hold it in an operative position. Preferably the support body is of L-shape and acts as a connector to join together mitre-cornered pieces of frame. Movement of the wheel support arm to a removal position disengages the cam member from the spring fingers, so that the arm can be disengaged from the pivot and removed. A spring is provided to urge the wheel support arm to the operative position, and the arm is provided with transversely-extending dimples that engage the bore side walls to centralize the wheel.

9 Claims, 4 Drawing Figures

RUNNER WHEEL SUPPORT

FIELD OF THE INVENTION

The present invention is concerned with improvements in or relating to supports for runner wheels, such as are used for mounting sliding doors and windows, and especially but not exclusively to such supports which are also usable as corner connectors for connecting together the frame parts of such doors and windows.

REVIEW OF THE PRIOR ART

It is now well established practice to make sliding doors and windows by connecting together at mitred corner joints four pieces of the same cross-section, which pieces commonly are hollow sections of extruded aluminum or aluminum alloy. It is also well-established practice to provide such a door or window frame along its lower edge with at least two spaced wheels or rollers engageable with a track to support and guide the frame in its movement. The provision of such wheels or rollers presents problems in that they must be strong and trouble-free, easily insertable and removable, must be capable of vertical adjustment to adjust the height of the frame on its track, and yet must be simple and relatively easy to manufacture to meet the demands of a highly competitive market.

DEFINITION OF THE INVENTION

It is an object of the invention to provide a new runner wheel support especially suitable for sliding doors and windows.

It is a more specific object to provide a new combined runner wheel support and corner connector especially suitable for sliding doors and windows assembled from mitre-jointed similar cross-sectioned hollow pieces.

In accordance with the present invention there is provided a runner wheel support for sliding doors, windows and the like of the type having a frame formed by connected hollow sections, the support comprising:

a support body adapted to be inserted in a frame hollow section for retention therein;

a removable wheel support member carrying a runner wheel and pivoted to the support body by a disengageable pivot for movement between stored, operative and removal positions; in which stored position the support body and wheel support member pivoted therein can be mounted in a hollow frame section; in which operative position the wheel can engage a track on which it runs; and in which removal position the wheel support member can be disengaged from the said pivot and thereby from the support body;

a cam member movable with the wheel support member about the said pivot;

a first cam-engaging means on the support body engaging the cam member to releasably retain the wheel support member in the said stored position; and a second cam-engaging means on the support body engaging the cam member to releasably retain the wheel support member in a lowermost operative position;

engagment of the cam member and a cam-engaging means retaining the wheel support member on the disengageable pivot and movement of the wheel support member to the said removal position disengaging the cam member and the cam engaging means to permit disengagement of the wheel support member from the pivot.

DESCRIPTION OF THE DRAWINGS

A corner connector and runner wheel support which is a particular preferred embodiment of the invention will now be described, by way of example, with reference to the accompanying diagrammatic drawings, wherein.

DESCRIPTION OF THE PREFERRED EMBODIMENT

Figure 1:
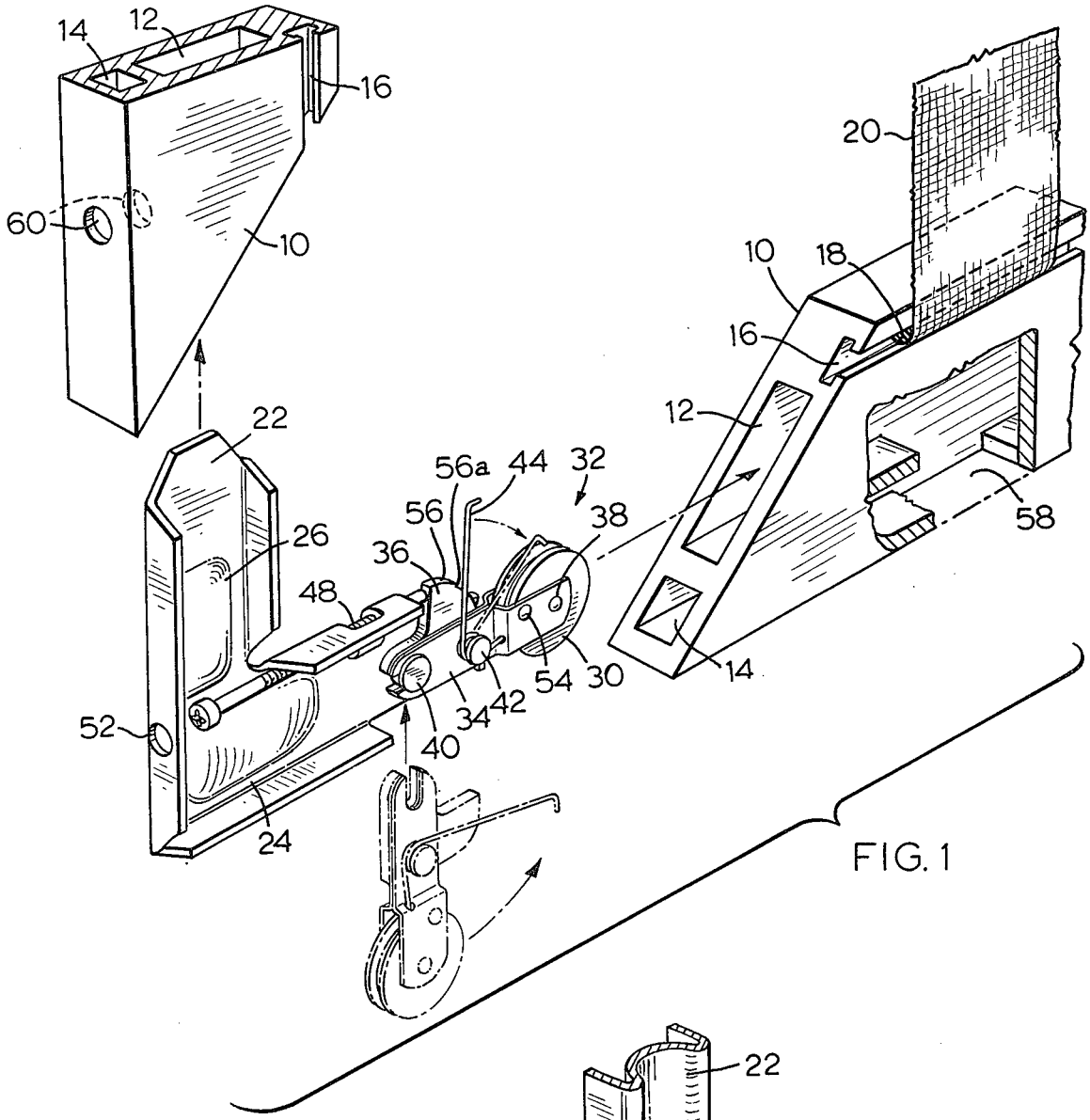
FIG. 1 is an exploded perspective view illustrating particularly the manner in which the device is employed as the corner connector for extruded metal sections to form them into a rectangular frame.

The device is usually employed in conjunction with an extruded metal section 10 of specific rectangular cross-section, four lengths of which are joined by four connectors at corresponding mitred junctions to form a rectangular frame. The extruded section includes a major rectangular cross-section bore 12, a minor rectangular cross-section bore 14, and a T cross-section slot 16 for the reception of a retention bead 18 employed to secure a member such as a screen 20 to the frame.

The device has an L-shape body as seen in side-elevation, with two arms 22 and 24 of the required widths and thickness to be a firm press fit in the bores 12 of two abutting lengths of the section. A substantial force is therefore required to press the two lengths on to the connector and thereafter they will be securely retained in assembled condition. The lengths of the arms are such that the resulting joint will have the required strength and rigidity, as will be apparent to those skilled in the art. The device is formed by stamping from a flat sheet of metal of appropriate thickness, so that each of the legs 22 and 24 is of open channel cross-section, the bore of the channel being provided with depressions such as 26 to increase its rigidity.

Figure 2:
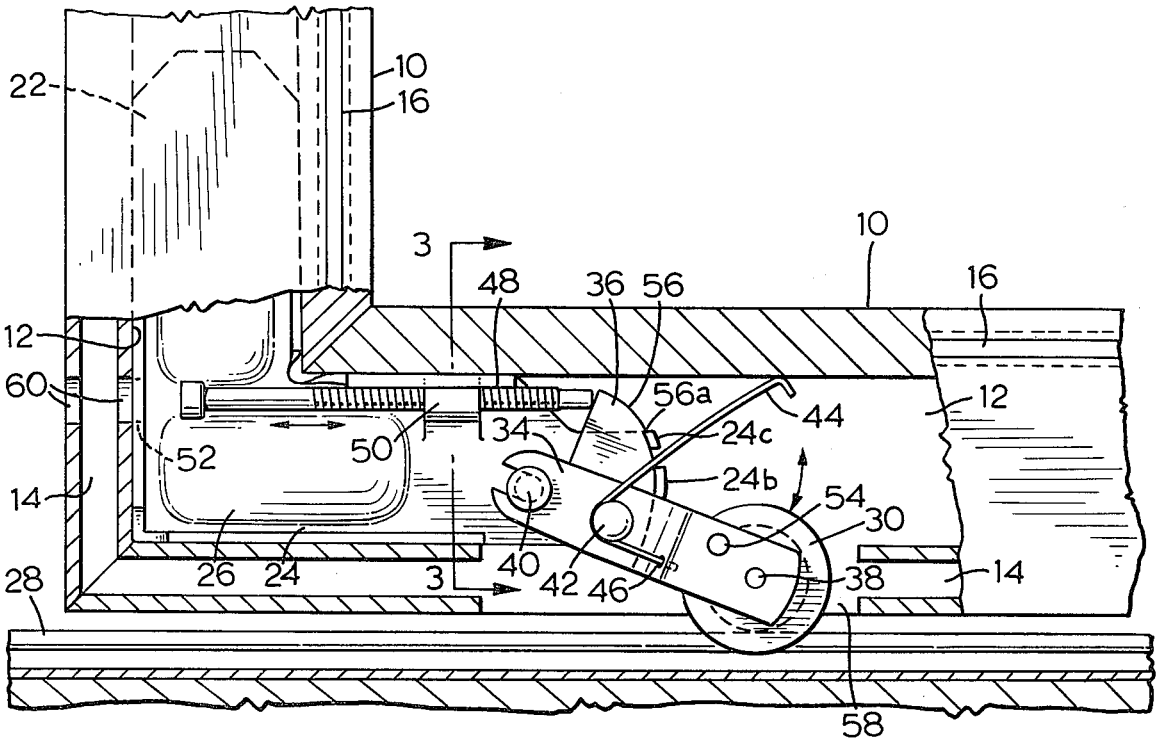
FIG. 2 is a side elevation of a frame corner with part of the nearer side wall of the frame members broken away to show the interior and the device mounted therein.

It will be apparent that the device as so far described can be used as a corner connector for a frame of the type described, but such a frame intended as a door or window requires some means by which it can be moved back and forth easily, for example on a track 28 as shown in FIG. 2. To this end the device is also arranged to mount and support a track runner wheel which in this embodiment is a grooved wheel 30 that fits over and runs on the track 28.

The wheel 30 is carried by a removable self-contained wheel assembly indicated by reference 32 consisting of an arm member 34 to which is fastened a cam member 36, one end of the arm being bifurcated to receive and support a wheel axle 38 on which the wheel is mounted. The other end of the arm member and the adjacent part of the cam member are slotted to be pivotally removably engageable on the shaft of a headed pin 40 on the arm 24, the pin and the slots thereby constituting a disengageable pivot between them. Another headed pin 42 on the arm 34 carries a coil spring 44, one end of which is anchored to the arm member 34 in aperture 46, while the other end is engageable with the inside wall of slot 12, as seen in FIG. 2.

Figure 3:
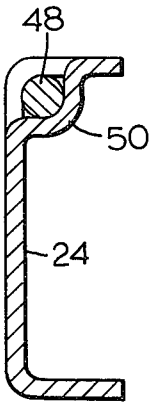
FIG. 3 is a cross-section on the line 3—3 of FIG. 2.

The device is provided with an adjusting screw 48 whose function will be explained below, the screw being mounted in a passage formed by striking out a part 50 of the arm 24, as seen most clearly in FIG. 3. Access to the head of the screw is obtained through an aperture 52 in the wall of arm channel 22. The side walls of the arm member 34 are provided with transversely-extending struck out dimples 54 which are of sufficient height to engage the side walls of the slot 12, centering the wheel 30 and preventing sideways movement thereof. The end of the arm 24 immediately adjacent to the cam member 36 is slotted to provide three corresponding cam-engaging fingers 24*a*, 24*b* and 24*c* which are bent at their ends to engage the edge face 56 of the cam member 36.

Figure 4:
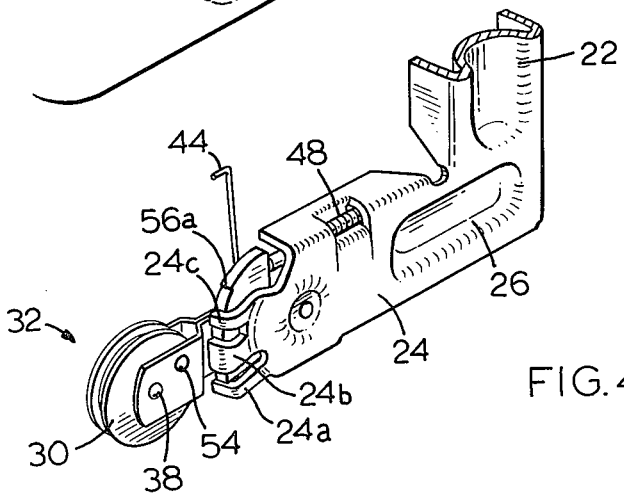
FIG. 4 is a perspective view of the device to show the reverse of the side seen in FIGS. 1 and 2.

A wheel assembly 32 is mounted on the pin 40 and placed in the "stored" position shown in FIGS. 1 and 4. In this position the lower finger 24*a* engages the lower edge of the cam member and positively retains the wheel assembly in the particular stored position. An operator now bends the spring 44 and inserts the arm 24 with the wheel assembly thereon into the respective slot 12 and forces it home, in which position the wheel 30 is opposite a slot 58 cut in the edge of the respective member 10. The other member 10 is now pushed on to the other arm 22 and pressed home, apertures 60 therein registering with the aperture 52.

A screwdriver is now inserted through the apertures 60 and 62 and used to move the screw 48 to the right as seen in FIGS. 1 and 2. This forces the arm and cam members clockwise about the pivot 40 until the cam member has pushed past the finger 24*a*, which is sufficiently flexible to move aside under this amount of force. The wheel assembly is now urged downwards by spring 44, but the extent of this downwards movement is positively limited to its lowest possible operating position by a ridge 56*a* on the cam face 56, which engages the upper finger 24*c*. The frame can therefore be moved while the wheel is in the position shown in FIG. 2 without danger of the wheel assembly falling out, and yet the assembly can be removed at any time, if required, through the slot 58, by the operator overcoming the retaining force provided by the ridge 56*a* and finger 24*c*. Once the frame is in position with the wheel 30 engaged on the track 28 the screw 48 is adjusted in axial position until the frame rides the desired height on the track.

It will be apparent that a frame will employ at least two combined corner connectors and runner wheel supports at the lower corners of the frame. In some embodiments the frame may be mounted to run between an upper and a lower track, in which case a combined device will be used at all four corners. The term "wheel" as used herein is intended also to include a roller or similar member.

I claim:

1. A runner wheel support for sliding doors, windows and the like of the type having a frame formed by connected hollow sections, the support comprising:

a support body adapted to be inserted in a frame hollow section for retention therein;

a removable wheel support member carrying a runner wheel and pivoted to the support body by a disengageable pivot for movement between stored, operative and removal positions; in which stored position the support body and wheel support member pivoted thereon can be mounted in a hollow frame section; in which operative position the wheel can engage a track on which it runs; and in which removal position the wheel support member can be disengaged from the said pivot and thereby from the support body;

a cam member movable with the wheel support member about the said pivot;

a first cam-engaging means on the support body engaging the cam member to releasably retain the wheel support member in the said stored position; and a second cam-engaging means on the support body engaging the cam member to releasably retain the wheel support member in a lowermost operative position;

engagement of the cam member and a cam-engaging means retaining the wheel support member on the disengageable pivot and movement of the wheel support member to the said removal position disengaging the cam member and the cam engaging means to permit disengagement of the wheel support member from the pivot.

2. The invention as claimed in claim 1, wherein the disengageable pivot pivoting the wheel support member to the support body comprises a headed pivot pin fixed to and extending from the support body, the wheel support member having an open-ended slot therein engageable over the shaft of the pin, whereby the wheel support member is removable from the pivot pin by longitudinal disengagement of the slot from the pin shaft while the wheel support member is in the said removal position.

3. The invention as claimed in claim 1, wherein the support body is of two-armed L-shape and constitutes a corner connector the two arms being adapted for insertion into respective hollow frame members to be connected by the runner wheel support, the said wheel support member being pivotally mounted by the disengageable pivot to one of the arms of the L-shaped support body.

4. The invention as claimed in claim 1, wherein the said wheel support member has transversely-extending projections thereon such that they will both engage for sideways supporting engagement with the respective opposite walls of the frame bore into which the runner wheel support is inserted.

5. The invention as claimed in claim 1, including means for disengaging the said first cam-engaging means and the cam member after the runner wheel support is mounted in a frame hollow section, the disengaging means comprising an axially-movable screw mounted by the support body to be engageable with the cam member and movable by an operator to rotate the cam member and the wheel support member about the said pivot until the first cam-engaging means and the cam member are disengaged.

6. The invention as claimed in claim 5, wherein the said axially-movable screw member is movable by the operator to a position in which it cooperates with the cam member by engagement therewith to limit upward rotation of the wheel support member and the wheel carried thereby about the pivot toward the stored position.

7. The invention as claimed in claim 5, wherein the said axially-movable screw member cooperates with the cam member by engagement therewith to set the operative position of the wheel support member and the wheel carried thereby relative to the frame hollow section in which the runner wheel support is mounted.

8. The invention as claimed in claim 1, and including a spring mounted to the wheel support member at a position spaced from the pivot and engageable with the frame upon insertion of the runner wheel support therein to urge the wheel support member from the said stored position toward the said operative position.

9. The invention as claimed in claim 8, wherein the said spring comprises a coil spring, and means for mounting the spring to the wheel support member comprises a headed pin extending from the wheel support member and having the spring wound about its shaft, one end of the spring being anchored to the wheel support member, and the other end being engageable with a frame hollow section in which the runner wheel support is inserted.

* * * * *